US008532554B2

(12) United States Patent
Uchiyama et al.

(10) Patent No.: US 8,532,554 B2
(45) Date of Patent: Sep. 10, 2013

(54) FIXING DEVICE AND FLEXIBLE SLEEVE USED IN THE FIXING DEVICE

(75) Inventors: Koji Uchiyama, Boise, ID (US); Takahiro Uchiyama, Mishima (JP); Hisashi Nakahara, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 13/070,948

(22) Filed: Mar. 24, 2011

(65) Prior Publication Data

US 2011/0236090 A1 Sep. 29, 2011

(30) Foreign Application Priority Data

Mar. 29, 2010 (JP) ..... 2010-075768
Mar. 18, 2011 (JP) ..... 2011-061599

(51) Int. Cl.
*G03G 15/20* (2006.01)

(52) U.S. Cl.
USPC ..... 399/329; 399/333

(58) Field of Classification Search
USPC ..... 399/333, 330, 328, 329; 219/216; 347/156; 430/124.3, 124.32
See application file for complete search history.

(56) References Cited

U.S. PATENT DOCUMENTS 5,210,579 A 5/1993 Setoriyama et al.
5,411,779 A * 5/1995 Nakajima et al. ..... 428/36.91
5,525,775 A 6/1996 Setoriyama et al.
7,200,355 B2 4/2007 Uchiyama et al.
7,203,438 B2 4/2007 Omata et al.
7,650,105 B2 1/2010 Ogawa et al.
2007/0026226 A1 * 2/2007 Chen et al. ..... 399/333 X

FOREIGN PATENT DOCUMENTS

CN 1504064 A 6/2004
JP 4-44075 2/1992
JP 4-44083 2/1992
JP 4-204980 7/1992
JP 4-204984 7/1992
JP 2000-131974 5/2000
JP 2004-045916 A 2/2004
JP 2006-91451 4/2006
JP 2009-158459 A 7/2009

OTHER PUBLICATIONS

Machine translation of JP 2006-091451 A dated Feb. 18, 2013.*
Chinese Office Action dated Mar. 26, 2013, in counterpart Chinese Application No. 201110076103.2.

* cited by examiner

*Primary Examiner* — Sophia S Chen
(74) *Attorney, Agent, or Firm* — Fitzpatrick, Cella, Harper & Scinto

(57) ABSTRACT

A fixing device for fixing on a recording material a toner image formed on the recording material includes: a flexible sleeve including a resinous base layer, a parting layer, and an adhesive layer for bonding the base and parting layers; a heater contacting the sleeve; a pressor for forming a nip with the sleeve, in which the recording material is nipped and conveyed; a member for applying a voltage, with the same polarity as toner; and a grounder contacting the recording material in the nip, for grounding the recording material. In a thickness direction of the layers, the electric resistance of the adhesive layer is larger than that of the parting layer, which is larger than that of the base layer. The member applies the voltage to the sleeve in contact with the base layer.

10 Claims, 3 Drawing Sheets

FIXING DEVICE AND FLEXIBLE SLEEVE USED IN THE FIXING DEVICE

FIELD OF THE INVENTION AND RELATED ART

The present invention relates to a fixing device, for fixing a toner image, for use with an image forming apparatus such as a copying machine, a laser beam printer, a facsimile machine or a multi-function machine having a combination of functions of these machines.

In the image forming apparatus, as the fixing device for fixing the toner image on a recording material, a SURF-heating-type fixing device has been used. This fixing device includes a heater, a stay, which is a heater supporting member, a sleeve, which is a heat-resistant film containing the heater, and a pressing roller for forming a fixing nip between the pressing roller and the sleeve to which the heater is contacted. When the recording material is conveyed while being nipped in the fixing nip, heat of the heater is applied to the recording material, so that an unfixed toner image formed on the surface of the recording material is heat-fixed on the surface of the recording material. Specifically, a ceramic heater capable of quickly increasing in temperature is used as the heater, and a thin film of polyimide is used as a material for the sleeve. As a result, the temperature at the fixing nip, which is a heating portion, can be increased up to a predetermined temperature in a short time, so that the fixing device has the advantage such that an electric-power saving and a wait-time reduction can be realized.

On the other hand, in the image forming apparatus of the type in which the toner image is fixed on the recording material, an image defect called "tailing" by the present inventors occurred in some cases. "Tailing" is a phenomenon that occurs when the recording material on which the unfixed toner image is placed (carried) enters the fixing device (image heating apparatus), the toner is scattered in a direction opposite from a conveyance direction, and occurs noticeably particularly with respect to an image of a horizontal line. When the toner forming the horizontal line is scattered in the direction opposite from the conveyance direction, the horizontal line constitutes such an image that the horizontal line leaves its traces and therefore this phenomenon is referred to as the "tailing". The "tailing" occurs due to the scattering of the toner by pressure when moisture contained in the recording material or the toner evaporates in the fixing nip. Particularly, "tailing" occurs noticeably in a state in which the recording material or the tailing takes up moisture in a high temperature and high humidity environment or the like.

As one of countermeasures against "tailing", in the SURF-heating-type fixing device, such a technique that an electric field is created between the sleeve and the recording material by applying a voltage to the sleeve has been used (e.g., Japanese Laid-Open Patent Application (JP-A) 2000-131974). As a result, the toner is contained on the recording material by an electrical force, so that the scattering has been suppressed.

FIG. 5 shows a schematic cross section of the fixing device when the electric field is created between a sleeve and a recording material P and also shows an electrical equivalent circuit formed at this time. The sleeve has a three-layer structure, from an inside to an outside, consisting of an unshown base layer, an adhesive layer 32 and a parting layer 33. Of these layers, in the adhesive layer 32, electroconductive particles are dispersed to impart electroconductivity to the adhesive layer 32 and to the adhesive layer 32, a negative voltage is applied by a power source 30 connected to the adhesive layer 32.

On the other hand, sheet-discharging rollers 31 are provided on a downstream side of the fixing nip in order to convey the recording material on which the toner image has been fixed. The sheet-discharging rollers 31 are constituted by a rubber or the like to which electroconductivity is provided, and are grounded.

A resistance Rfp represents the resistance from an output end of the power source 30 to a position, of the adhesive layer 32 of the sleeve, close to the fixing nip. The resistance Rfp also includes the contact resistance of an electric power supply contact to the adhesive layer 32 of the sleeve and includes the resistance of the adhesive layer 32 or the like. A resistance Rft represents the resistance of the parting layer 33 of the sleeve with respect to a thickness direction. A resistance Rp represents the resistance of the recording material. A resistance Rg represents the resistance of the sheet-discharging rollers 31.

When the recording material P passes through the fixing nip and is nipped between the sheet-discharging rollers 31, via this recording material P, a circuit through which current flows is formed from the adhesive layer 32 to the grounded sheet-discharging rollers 31. At both ends of the resistances in the current flow circuit, a voltage is generated by voltage drop. By the voltage generated by the resistance Rft of the parting layer 33, at a periphery of the fixing nip, an electric field Eft is generated in a direction from the recording material P toward the adhesive layer 32. The toner has a negative charge polarity and therefore a constraint force of the toner on the recording material is generated by this electric field Eft.

In order to increase the constraint force, these are two methods including one in which a voltage to be applied to the adhesive layer of the sleeve is increased, and one in which the resistance (Rft) of the parting layer is made relatively larger than other resistances (Rfp, Rp, Rg, etc.) to increase a value of a divided voltage applied to the parting layer.

However, when the resistance of the parting layer is excessively increased, an image defect called "separation offset" by the present inventors can occur, such that a separation discharge at the time when the recording material has passed through the fixing nip occurs in a large amount to electrostatically separate the unfixed toner image from a subsequent recording material. In the "separation offset", when the recording material is discharged from the fixing nip, the sleeve is separation-charged by the separation discharge phenomenon between a trailing end of the recording material and the sleeve, so that electric charge is left on the surface of the sleeve so as to attract the toner toward the sleeve. As a result, the toner on the subsequent recording material is attracted by this electric charge and is separated from the recording material. Specifically, e.g., in the case where a solid black image or a halftone image is formed on the entire sleeve, the toner is separated by the sleeve, so that a horizontal white line appears on the image. This problem is liable to occur in a low humidity environment in which the recording material has a high resistance.

In order to prevent this separation charging, e.g., it would be considered that the electroconductivity is imparted to the parting layer to diffuse the electric charge, due to the separation charging, from the surface of the parting layer. However, in this case, the resistance of the parting layer, which is an outermost layer, is lowered, thus weakening the electric field intensity at the periphery of the fixing nip.

SUMMARY OF THE INVENTION

A principal object of the present invention is to provide a fixing device capable of permitting high-quality image formation by suppressing separation charging of a sleeve while sufficiently retaining a constraint force of toner onto a recording material to thereby prevent image defects, such as tailing and separation offset.

Another object of the present invention is to provide a flexible sleeve for use with the fixing device.

According to an aspect of the present invention, there is provided a fixing device for fixing on a recording material a toner image formed on the recording material, the fixing device comprising:

a flexible sleeve including a resinous base layer, a parting layer and an adhesive layer for bonding the base layer and the parting layer;

a heater contacted to an inner surface of the sleeve;

a pressing member for forming a nip, in which the recording material on which the toner image has been formed is nipped and conveyed, between itself and the sleeve to which the heater is contacted;

a voltage applying member for applying a voltage, of a polarity identical to a polarity of toner; and a grounding member, contactable to the recording material in a nipped state in the nip, for grounding the recording material. In a thickness direction of the layers, the electric resistance of the adhesive layer is larger than that of the parting layer and the electric resistance of the parting layer is larger than that of the base layer. The voltage applying member applies the voltage to the sleeve in contact with the base layer.

According to another aspect of the present invention, there is provided a flexible sleeve for use a fixing device for fixing on a recording material a toner image formed on the recording material, the flexible sleeve comprising:

a resinous base layer;

a parting layer; and an adhesive layer for bonding the base layer and the parting layer. In a thickness direction of the layers, the electric resistance of the adhesive layer is larger than that of the parting layer and the electric resistance of the parting layer is larger than that of the base layer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments for carrying out the present invention will be specifically described with reference to the drawings. However, with respect to dimensions, materials, shapes, relative arrangements and the like of constituent elements described in the following embodiments, the scope of the present invention is not limited thereto unless otherwise specified.

Embodiment 1

Image Forming Apparatus

Figure 1:
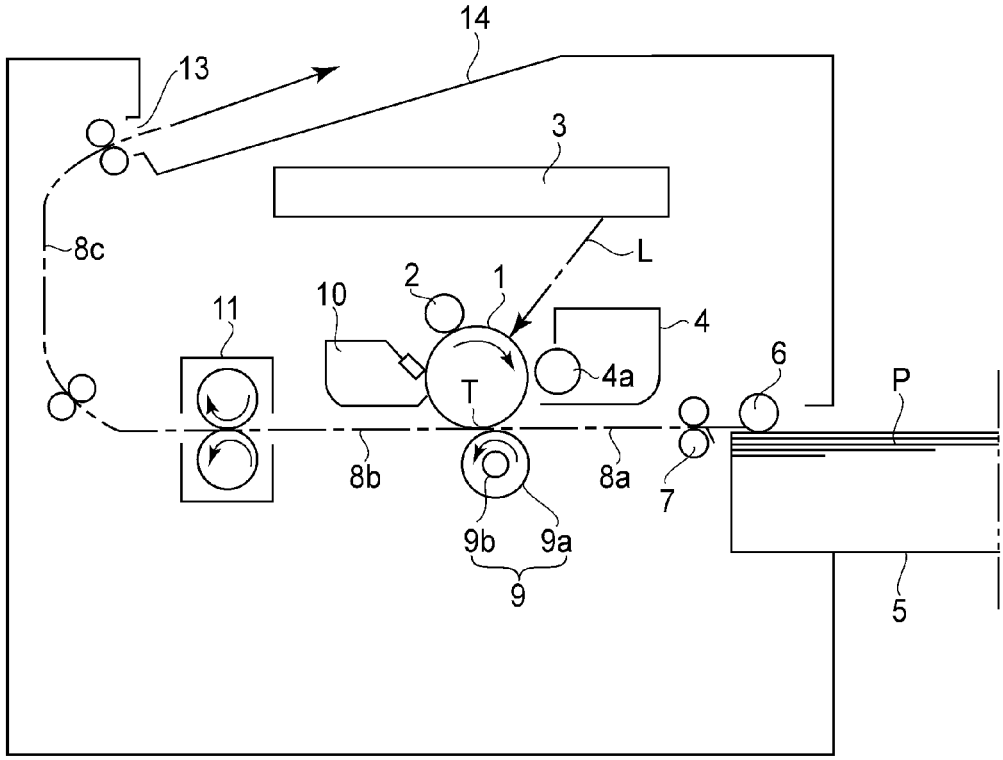
FIG. 1 is a schematic illustration of an image forming apparatus in Embodiment 1.

FIG. 1 is a schematic illustration of an image forming apparatus according to this embodiment. The image forming apparatus in this embodiment is a laser beam printer utilizing a transfer-type electrophotographic process. In this embodiment, the image forming apparatus capable of forming an image only on one side is used as an example.

An electrophotographic photosensitive drum 1 as an image bearing member is rotationally driven in the clockwise direction indicated by an arrow at a predetermined peripheral speed (process speed).

A contact charging roller 2 electrically charges the surface of the photosensitive drum 1 uniformly to a predetermined polarity and a predetermined potential (primary charging). In this embodiment, a voltage of −600 V is applied to the charging roller 2, so that the photosensitive drum 1 is charged to a polarity and a potential which are substantially equivalent to those of the applied voltage.

A laser beam scanner 3 as an image exposure means outputs laser light L that has been subjected to ON/OFF modulation corresponding to time-serial electric digital pixel signals, of objective image information, inputted from an unshown external device, such as a host computer. The charged surface of the photosensitive drum 1 is subjected to scanning exposure (irradiation) with the laser light L. By this scanning exposure, negative charges at an exposure light portion on the surface of the photosensitive drum 1 are removed, so that an electrostatic latent image corresponding to the objective image information is formed on the photosensitive drum 1.

A developing device 4 develops the electrostatic image on the photosensitive drum 1 into a toner image as a transferable image by supplying toner from a developing sleeve 4*a* to the photosensitive drum 1. In the case of the laser beam printer, in general, a reverse-development-type printer is used, in which the toner is deposited on the exposure light portion of the electrostatic latent image. In this embodiment, the toner is negatively charged and is deposited on the exposure light portion from which the negative electric charges have been removed.

In a sheet-feeding sheet cassette 5, sheets of a recording material P are stacked and accommodated. A sheet feeding roller 6 is driven on the basis of a sheet feeding start signal, so that the sheets of the recording material P in the sheet-feeding cassette 5 are separated and fed one by one. The fed recording material P passes through registration rollers 7 and a sheet path 8*a* and is guided into a transfer portion T, with predetermined timing, which is a contact nip between the photosensitive drum 1 and a transfer portion comprising a transfer roller 9 as a contactable and rotatable transfer member. That is, conveyance of the recording material P is controlled by the registration rollers 7 with timing such that a leading end portion of a toner-image-transfer region of the recording material P just reaches the transfer portion T when a leading end portion of a toner-image-forming region on the photosensitive drum 1 reaches the transfer portion T.

The recording material P is guided to the transfer portion T. During the conveyance at the transfer portion T, to the transfer portion 9, a transfer voltage (transferable) controlled at a predetermined voltage value is applied from an unshown transfer-bias application voltage source. The transfer bias is of a polarity opposite from the charge polarity of the toner. Therefore, the transfer bias of the polarity opposite from the charge polarity of the toner is applied to the transfer roller 9, at the transfer portion T, and the toner image on the photosensitive drum 1 is electrostatically transferred onto the surface of the recording material P.

The recording material P on which the toner image has been transferred at the transfer portion T is separated from the photosensitive drum 1 and passes through a sheet path 8*b* to be conveyed into a fixing device 11, which is an image heating apparatus, and then is subjected to fixing for heating and pressing the toner image.

On the other hand, the photosensitive drum 1 after the toner image is transferred onto the recording material P is subjected to removal of untransferred toner, paper dust or the like by a cleaning device 10, so that the surface of the photosensitive drum 1 is cleaned and then is repetitively subjected to image formation.

The recording material P, which has passed through the fixing device 11, is guided on a sheet path 8*c* side and then is discharged from a sheet discharge opening 13 onto a sheet discharge tray 14.

Here, the transfer portion 9, which is the contactable and rotatable transfer member, in general, comprises an elastic sponge roller including a metal core 9*b* of SUS, Fe or the like and a semiconductive sponge elastic layer 9*a*, which is formed on the metal core and is adjusted to have a resistance of $1\times10^{6}\Omega$ to $1\times10^{10}\Omega$ by carbon black, ion-conductive filler or the like. In this embodiment, an ion-conductive transfer roller prepared by integrally and coaxially molding the elastic layer 9*a*, in a roller shape so as to have electroconductivity by reaction of NBR rubber with a surfactant or the like, around the metal core 9*b* was used. The transfer roller had a resistance value in a range from $1\times10^{8}$ to $5\times10^{8}\Omega$.

(Fixing Device)

Figure 2:
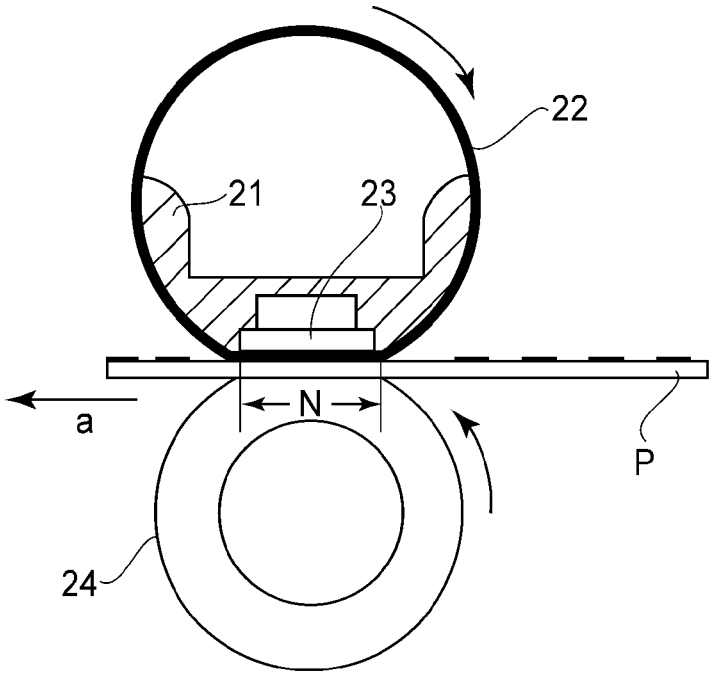
FIG. 2 is a schematic illustration of a fixing device in Embodiment 1.

FIG. 2 is a schematic illustration of the fixing device 11 of the SURF-heating type in this embodiment. This device is of a tension-less type as described in, e.g., JP-A Hei 4-44075 to JP-A Hei 4-44083 and JP-A Hei 4-204980 to JP-A Hei 4-204984.

The SURF-heating-type fixing device of the tension-less type includes a heat-resistant sleeve 22 having an endless belt shape and a cylindrical shape. At least a part of a circumferential portion of the sleeve 22 is always in a tension free state (in which no tension is applied). The sleeve 22 is rotated by a rotational driving force of a pressing roller 24.

A stay 21 is a heat-resistant and rigid member performing the function of a heat holding member and also the function of a sleeve guide.

A ceramic heater 23 as a heating member is provided and held on a lower surface of the stay 21 along a longitudinal direction of the stay 21. Incidentally, the longitudinal direction referred to herein is a widthwise direction of the recording material P perpendicular to a conveyance direction a of the recording material P. The stay 21 can be constituted by high heat-resistant resin materials such as polyimide, polyamideimide, PEEK, PPS and a liquid crystal polymer, and by composite materials of these resin materials with ceramics, metal, glass and the like. In this embodiment, the liquid crystal polymer was used. The heat-resistant sleeve 22, which has the endless cylindrical shape and flexibility, is externally engaged on the stay 21 including the heater 23. The sleeve 22 contains the heater 23 inside thereof and slides on the heater 23. The inner circumferential length of the endless heat-resistant sleeve 22 is made longer by, e.g., about 3 mm than the outer circumferential length of the stay 21 including the heater 23. Therefore, the sleeve 22 is externally engaged on the stay 21 with allowance in terms of the circumferential length.

The sleeve 22 may have a film thickness of 100 μm or less, preferably 70 μm or less and 20 μm or more, in order to improve a quick start property thereof by decreasing its thermal capacity. Further, as the material for the sleeve 22, it is possible to use a single-layer film of heat-resistant resin such as PTFE, PFA or FEP or a composite layer film prepared by coating the film of PTFE, PFA or FEP on the outer circumferential surface of a film of polyimide, polyamideimide, PEEK, PES, PPS or the like. In this embodiment, the composite film prepared by coating the film of PTFE on the outer circumferential surface of an about 60 μm-thick polyimide film was used. The outer diameter of the sleeve 22 was 18 mm. This sleeve has a lamination constitution including a base layer, an adhesive layer and a parting layer in this order from its inside to its outside. Details of the base layer, the adhesive layer and the parting layer and a film value applying method for preventing tailing will be described later.

The pressing roller 24 as a pressing member opposes the heater 23 via the sleeve 22 and press-contacts the sleeve 22 to form a fixing nip N. Further, the pressing roller 24 performs the function as a sleeve-outer-surface contact driving means for rotating the sleeve 22 by its rotation. The pressing roller 24 includes a metal core, an elastic layer and a parting layer as an outermost layer and is provided in press-contact with the surface of the sleeve 22, contacted to the heater 23, with a predetermined urging force exerted by unshown bearing means and urging means. In this embodiment, a metal core of aluminum, an elastic layer of silicone rubber, and a parting layer of PFA tube formed in a thickness of about 30 μm were used. The outer diameter of the pressing roller 24 was 20 mm, and the thickness of the elastic layer was 3 mm.

The pressing roller 24 is rotationally driven in an arrow direction at a predetermined peripheral speed by an unshown driving system. By the rotational drive of the pressing roller 24, a rotational force acts on the sleeve 22 through a frictional force between the pressing roller 24 and the outer surface of the sleeve 22 in the fixing nip N. As a result, the sleeve 22 is rotated around the stay 21 by the rotation of the pressing roller 24 in an arrow direction at a peripheral speed substantially equal to the rotational peripheral speed of the pressing roller 24, while sliding on the surface of the heater 23 in the fixing nip N at its inner surface side.

The fixing device 11 is in an operable state when the temperature of the heater 23 rises to a predetermined temperature and the rotational peripheral speed of the sleeve 22 by the rotation of the pressing roller 24 is in a steady state. In this operable state, into the fixing nip N formed between the pressing roller 24 and the sleeve 22 contacted to the heater 23, the recording material P, which is a material to be heated and is subjected to image fixation, is guided from the transfer portion T. Then, the recording material P is conveyed together with the sleeve 22 while being nipped in the fixing nip N, so that the heat of the heater 23 is applied to the recording material P via the sleeve 22 and thus an unfixed visible image (toner image) is heat-fixed on the surface of the recording material P. The recording material P having passed through the fixing nip N is separated from the sleeve 22 and is conveyed.

(Tailing Preventing Means)

Figure 3:
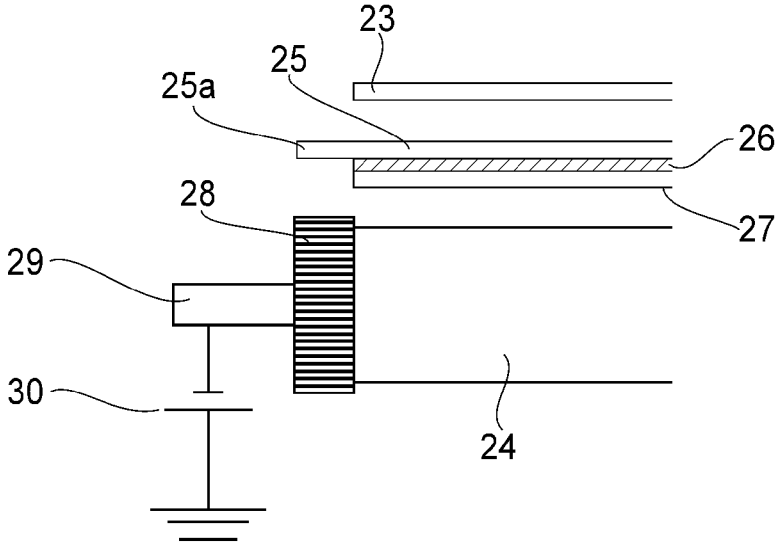
FIG. 3 is a schematic illustration of a sleeve contact and its peripheral portion in Embodiment 1.

Next, a tailing preventing means will be described. FIG. 3 shows a schematic structure in the neighborhood of a contact of the sleeve 22 to which a voltage for preventing the tailing is to be applied. In this embodiment, the base layer 25 is formed of a resin material principally containing polyimide and to which electroconductive filler as a filler material principally containing carbon black is added and electroconductivity is imparted. At a longitudinal end portion of the sleeve 22, a base layer exposure portion 25*a* at which the base layer 25 is exposed is formed as is used as the (electric) contact of the sleeve 22.

The voltage application to the sleeve 22 is performed from the pressing roller 24 side. At a longitudinal end portion of the pressing roller 24, at a position in which the pressing roller aligned with the base layer exposure portion 25*a* of the sleeve 22 with respect to the longitudinal direction, an electroconductive rubber ring, to which electroconductivity is imparted, is wound about a pressing-roller metal core 29. To the pressing-roller metal core 29, a power source 30 for applying a negative voltage to the pressing-roller metal core 29 is connected, so that the voltage is applied to the base layer 25 of the sleeve 22 via the pressing-roller metal core 29 and the electroconductive rubber ring 28.

Into the fixing device 11 in this state, the recording material P on which an unshown unfixed toner is placed enters. Then, when the recording material P, conveyed while being nipped in the fixing nip N, reaches sheet-discharging rollers 31 which have been grounded as shown in FIG. 4, a current flow path (circuit) through which current flows in the order of the pressing-roller metal core, the electroconductive rubber ring, the sleeve, the recording material and the sheet-discharging rollers is formed.

In order to form this current from path, in this embodiment, a constitution in which the sheet-discharging rollers 31, as a grounding member which has been grounded on a downstream side of the fixing nip N, is employed. However, the grounding member for forming the current flow path is not limited to the constitution as in this embodiment. For example, it would be also considered that not the sheet-discharging rollers, but a brush-like grounding member is used and the current flow path is formed by connecting and grounding the brush-like grounding member from the back surface of the recording material P. The position of the brush-like grounding member is not limited to the downstream side but may also be an upstream side of the fixing nip N. Further, it would also be considered that a method in which a grounding member such that it guides the recording material P is disposed at the fixing nip N and is grounded to form the current flow path is employed. Also, even such a grounding member is contacted to the recording material P when it guides the recording material P, so that the current flow path can be formed.

Figure 4:
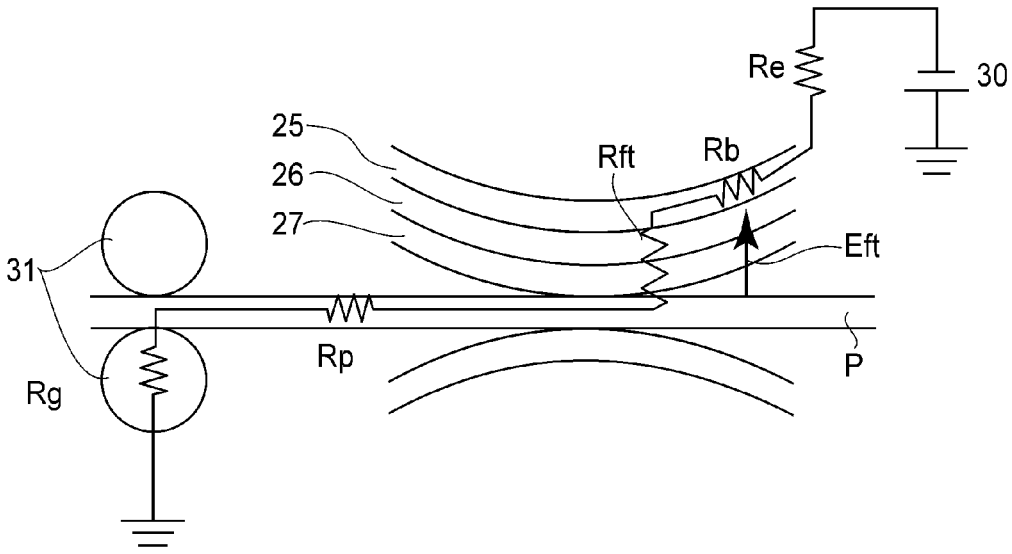
FIG. 4 is a schematic diagram of an electric field exerted in a direction in which tailing is prevented in Embodiment 1.
Figure 5:
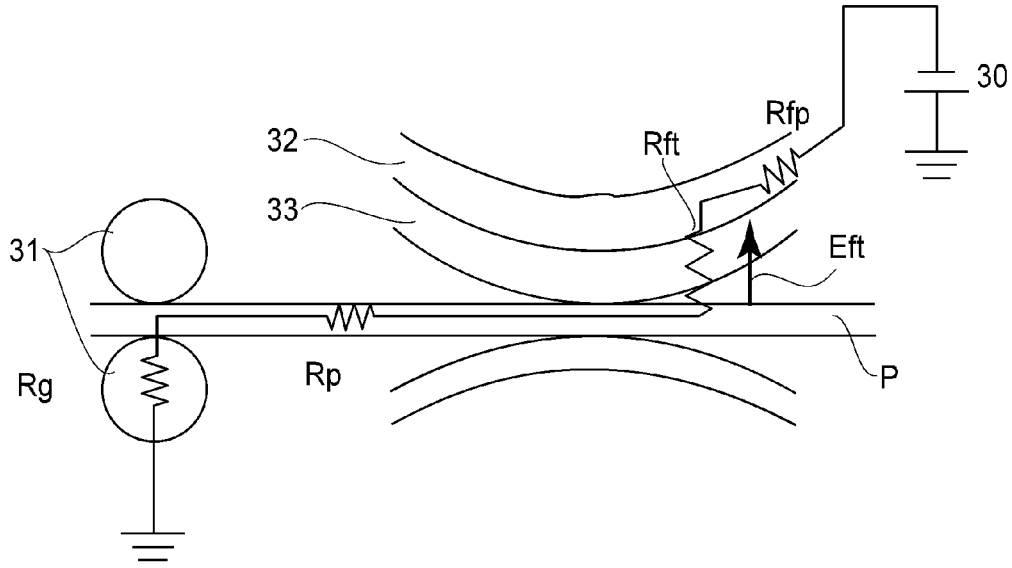
FIG.5 PRIOR ART
FIG. 5 is a schematic diagram of the electric field exerted in the direction in which the tailing is prevented in a conventional fixing device.

FIG. 4 shows an electrical equivalent circuit formed in the constitution shown in FIG. 3. A voltage by voltage drop is generated at both ends of each of the resistances in the current flow path. There are five resistances Re, Rb, Rft, Rp and Rg in the equivalent circuit. The resistance Re is the total resistance of the circuit resistance from the power source 30 to the base layer 25 of the sleeve 22 and the contact resistance between the base layer 25 of the sleeve 22 and the electroconductive rubber ring 28. The resistance Rb is the resistance from a contact position, of the base layer 25 of the sleeve 22 with the electroconductive rubber ring 28, to the neighborhood of the fixing nip N. The resistance Rft is the total resistance of the adhesive layer 26 and the parting layer 27 of the sleeve 22 with respect to the thickness direction. The resistance Rp is the resistance from the neighborhood of the fixing nip N to the sheet-discharging rollers 31. The resistance Rg is the resistance of the sheet-discharging rollers 31.

Of these resistances, the resistance Re is the resistance of the electric circuit which is a conductor and is the contact resistance between the base layer 25 and the electroconductive rubber ring 28, and therefore, is a very small value. Further, in a high temperature and high humidity environment in which tailing is liable to occur, the resistance Rp of the paper, as the recording material P, is in a low state. The value of the resistance Rp is about $1\times10^3\Omega$, thus being a small value compared with those of the resistances Rb and Rft. The value of the sheet-discharging rollers 31 is also several hundred Q and therefore the resistance Rg is very small compared with the resistances Rb and Rft.

Now, in the case where a total resistance value of a 4 μm-thick adhesive layer 26 and a 10 μm-thick parting layer 27 is the resistance Rft, when the current is carried in the current flow path, an electric field Eft is generated between the base layer 25 and the recording material P with respect to a direction indicated by an arrow in FIG. 4. By this electric field Eft, the toner having the negative charging property is constrained by the recording material P, thus leading to prevention of tailing.

Here, the resistance values of the adhesive layer 26 and the parting layer 27 are important. When these resistance values are increased, the value of the voltage generated by the voltage drop becomes large, so that the intensity of the electric field Eft for constraining to toner onto the recording material P is increased. As a result, improvement in the tailing level can be effected. However, when the resistance values are excessively high, separation charging at the time when the recording material P passes through the fixing nip N becomes large, so that a separation-offset level is lowered.

Further, the resistance Rb, which is the resistance of the base layer 25, may preferably be as small as possible. This is because by making the resistance Rb being as small as possible, the value of the resistance Rft can be made relatively large.

In this embodiment, the resistance of the parting layer 27 is adjusted by adding filler having electroconductivity to the parting layer 27. Specifically, carbon black is dispersed to provide a volume resistivity of about $1\times10^{12}$ Ωcm. As a result, the resistance value of the 10 μm-thick parting layer 27 is about $6\times10^7\Omega$.

On the other hand, the adhesive layer 26 is formed of a material, having the volume resistivity of $1\times10^{15}$ Ωcm or more, to which the filler is not mixed, so that the resistance value of the 4 μm-thick adhesive layer 26 is about $3\times10^{10}\Omega$.

In the base layer 25, the electroconductive filler principally containing the carbon black is dispersed similarly as in the case of the parting layer 27 and thus a polyimide film which has been adjusted in volume resistivity at about $1\times10^2$ Ωcm is used. As a result, the resistance Rb of the base layer 25 from the contact (point) with the electroconductive rubber ring 28 to the fixing nip N region is a value of about $4\times10^4\Omega$.

As the filler added into the base layer 25, the carbon black is used in this embodiment but in the same carbon type filler, carbon nanofiber, carbon nanotube or the like may also be suitable from the viewpoint of imparting the electroconductivity. Further, it has been known than such whisker-like filler provides a good result also with respect to strength of the base layer 25, so that they are a desirable material also from the viewpoint of the strength. As the filler other than the carbon type, it is also possible to use metallic filler including fine powder of metal such as Ag, Cu or Ni, a metal oxide material such as ZnO or $SnO_2$, or fibers of metal such as Al.

By the filler addition as described above, it is possible to carry the current into the base layer 25 and therefore, as described above, the voltage can be applied to the base layer 25 by contacting the base layer 25 to the electroconductive rubber ring 28. That is, the voltage to be applied to the sleeve 22 is applied to the base layer 25.

With respect to the parting layer 27, the resistance is lowered to suppress the separation offset and on the other hand, the total resistance value of the adhesive layer 26 and the parting layer 27 is increased by increasing the resistance of the adhesive layer 26, so that the force of the electric field generated between the base layer 25 and the recording material P is kept at a value sufficient to prevent tailing.

(Investigation)

Here, in order to confirm the effect of the constitution as described above, the following investigation was conducted.

The image forming apparatus and fixing device used for the investigation are the same as those except for the sleeve, and therefore, will be omitted from description.

In Embodiments and Comparative Embodiments, sleeves including base layers having volume resistivity values of $1\times10^4$ Ωcm and $1\times10^8$ Ωcm were prepared by changing an amount of the filler added into the base layers, and were compared with the sleeve in this embodiment (Embodiment 1).

With respect to evaluation items, evaluation of "tailing" was made as evaluation 1 and evaluation of "separation offset" was made as evaluation 2. Evaluation methods of evaluations 1 and 2 are as follows.

Evaluation 1: With respect to the "tailing", smooth paper of 75 g/m$^2$ in basis weight (mfd. by Xerox Corp.) was left standing for 48 hours in a laboratory kept at a temperature of 32.5° C. and a humidity 80% RH to take up moisture and then was left standing for 12 hours or more in the same laboratory. Then, a printer and a cartridge which were in an accustomed state were used to carry 3 sheets of the moisture-absorbing paper, so that the evaluation of tailing was made. An image of a horizontal line of 4d27s (4 dots and 27 spaces) formed on the entire surface at a resolution of 6000 dpi was used and was compared with a predetermined boundary sample by eye observation to evaluate at three levels "Good", "Fair" and "No good". "Good" represents "better than the boundary sample". "Fair" represents "the same level as that of the boundary sample". "No good" represents "worse than the boundary sample".

Evaluation 2: With respect to the "separation offset", the smooth paper of 75 g/m$^2$ in basis weight (mfd. by Xerox Corp.), which was the same as that used for the tailing study, was left standing for 48 hours in a laboratory kept in a low temperature and low humidity environment (temperature: 15° C. and humidity: 10% RH) to lower moisture content in contrast to the case of the evaluation of the tailing and then the thus-prepared left-standing paper increased in resistance was left standing for 12 hours or more in the same laboratory. Then, the printer and the cartridge which were in an accustomed state were used to continuously carry sheets of the moisture-absorbing paper, so that the evaluation of the separation offset was made. An image of a horizontal line of 2d3s (2 dots and 3 spaces) formed on the entire surface at a resolution of 6000 dpi was used and was evaluated at three levels "Good", "Fair" and "No good", similarly as in the case of the tailing evaluation.

A result of the evaluations 1 and 2 is summarized in Table 1. In Comparative Embodiments 1 and 2, all the resistances of the base layers were adjusted. For this reason, the base layer through which the current should originally be passed constitutes the electric resistance, so that the voltage drop occurs also in the base layer. As a result, values of divided voltages applied to the adhesive layer and the parting layer became small, so that the level of the tailing was deteriorated.

In Embodiment 2, when a material adjusted in volume resistivity to $1\times10^4$ Ωcm was used for the base layer, the resistance value of the base layer was $4\times10^6$Ω. The tailing level was the level "Fair", and the separation-offset level was the level "Good". These levels were good substantially similar to those in Embodiment 1.

In Comparative Embodiment 1, when a material adjusted in volume resistivity to $1\times10^6$ Ωcm was used for the base layer, the resistance value of the base layer was $4\times10^8$Ω. The tailing level deteriorated, i.e., was the level "No good". This is because the resistance of the base layer is increased, and thus, the intensity of the electric field for suppressing tailing is weakened.

In Comparative Embodiment 2, when a material adjusted in volume resistivity to $1\times10^8$ Ωcm was used for the base layer, the resistance value of the base layer was $4\times10^{10}$Ω. The tailing level worsened, i.e., was the level "No good".

TABLE 1

| | EMB. 1 | EMB. 2 | COMP. EMB. 1 | COMP. EMB. 2 |
|---|---|---|---|---|
| BLR*1 (Ω) | $4\times10^4$ | $4\times10^6$ | $4\times10^8$ | $4\times10^{10}$ |
| ALR*2 (Ω) | $3\times10^{10}$ | $3\times10^{10}$ | $3\times10^{10}$ | $3\times10^{10}$ |
| PLR*3 (Ω) | $6\times10^7$ | $6\times10^7$ | $6\times10^7$ | $6\times10^7$ |
| EV1*4 | "Good" | "Fair" | "No good" | "No good" |
| EV2*5 | "Good" | "Good" | "Good" | "Good" |

*1"BLR" represents a base layer resistance.
*2"ALR" represents an adhesive layer resistance.
*3"PLR" represents a parting layer resistance.
*4"EV1" represents evaluation 1 for the tailing.
*5"EV2" represents evaluation 2 for the separation offset.

From the above evaluation result, it is understood that the resistance value of the base layer may desirably be about $4\times10^6$Ω or less.

Next, the evaluations 1 and 2 were performed by preparing sleeves changed in volume resistivity from $1\times10^8$ Ωcm to $1\times10^{15}$ Ωcm by changing the amount of the filler added into the adhesive layer.

A result of the evaluations 1 and 2 is summarized in Table 2.

In Embodiment 3, when a material adjusted in volume resistivity to $1\times10^{13}$ Ωcm was used for the adhesive layer, the resistance value of the 4 μm-thick adhesive layer was $3\times10^8$Ω. The tailing level was the level "Fair", and the separation-offset level was the level "Good", thus being good.

In Comparative Embodiment 3, when a material adjusted in volume resistivity to $1\times10^{10}$ Ωcm was used for the adhesive layer, the resistance value of the 4 μm-thick adhesive layer was $3\times10^5$Ω. The tailing level was changed, i.e., deteriorated to the level "No good".

In Comparative Embodiment 4, when a material adjusted in volume resistivity to $1\times10^{10}$ Ωcm was used for the base layer, the resistance value of the 4 μm-thick adhesive layer was $3\times10^5$Ω. The tailing level was further changed, i.e., worsened to the level "No good".

TABLE 2

| | EMB. 1 | EMB. 3 | COMP. EMB. 3 | COMP. EMB. 4 |
|---|---|---|---|---|
| BLR*1 (Ω) | $4\times10^4$ | $4\times10^4$ | $4\times10^4$ | $4\times10^4$ |
| ALR*2 (Ω) | $3\times10^{10}$ | $3\times10^8$ | $3\times10^5$ | $3\times10^3$ |
| PLR*3 (Ω) | $6\times10^7$ | $6\times10^7$ | $6\times10^7$ | $6\times10^7$ |
| EV1*4 | "Good" | "Fair" | "No good" | "No good" |
| EV2*5 | "Good" | "Good" | "Good" | "Good" |

*1"BLR" represents a base layer resistance.
*2"ALR" represents an adhesive layer resistance.
*3"PLR" represents a parting layer resistance.
*4"EV1" represents evaluation 1 for the tailing.
*5"EV2" represents evaluation 2 for the separation offset.

From the above evaluation result, it is possible to confirm the tendency that the tailing level is worsened by decreasing the resistance of the adhesive layer. In the case where the resistance value of the adhesive layer is adjusted at a level such that the separation offset is not caused, although the separation-offset prevention level varies depending on the resistance value of the adhesive layer, it is understood that the resistance value of the adhesive layer may desirably be about $3\times10^8\Omega$ or more.

Further, the evaluations 1 and 2 were performed by preparing sleeves changed in volume resistivity from $1\times10^{10}$ Ωcm to $1\times10^{17}$ Ωcm by changing the amount of the filler added into the parting layer.

A result of the evaluations 1 and 2 is summarized in Table 3.

TABLE 3

| | COMP. EMB. 5 | COMP. EMB. 6 | EMB. 1 | EMB. 4 | EMB. 5 |
|---|---|---|---|---|---|
| BLR*1 (Ω) | $4\times10^4$ | $4\times10^4$ | $4\times10^4$ | $4\times10^4$ | $4\times10^4$ |
| ALR*2 (Ω) | $3\times10^{10}$ | $3\times10^{10}$ | $3\times10^{10}$ | $3\times10^{10}$ | $3\times10^{10}$ |
| PLR*3 (Ω) | $6\times10^{12}$ | $6\times10^{10}$ | $6\times10^7$ | $6\times10^5$ | $6\times10^9$ |
| EV1*4 | "Good" | "Good" | "Good" | "Fair" | "Good" |
| EV2*5 | "No good" | "No good" | "Good" | "Good" | "Fair" |

*1"BLR" represents a base layer resistance.
*2"ALR" represents an adhesive layer resistance.
*3"PLR" represents a parting layer resistance.
*4"EV1" represents evaluation 1 for the tailing.
*5"EV2" represents evaluation 2 for the separation offset.

In Comparative Embodiment 5, when a material adjusted in volume resistivity to $1\times10^{17}$ Ωcm was used for the partition layer, the resistance value of the μm-thick parting layer was $6\times10^{12}\Omega$. The tailing level was good at the level "Good" but the separation-offset level was the level "No good".

In Comparative Embodiment 6, when a material adjusted in volume resistivity to $1\times10^{15}$ Ωcm was used for the partition layer, the resistance value of the μm-thick parting layer was $6\times10^{10}\Omega$. The separation-offset level was the level "No good".

In Embodiment 4, when a material adjusted in volume resistivity to $1\times10^{10}$ Ωcm was used for the partition layer, the resistance value of the 10 μm-thick parting layer was $6\times10^5\Omega$. The tailing level was good at the level "Good" but the separation-offset level was changed, i.e., was the level "Fair".

In Embodiment 5, when a material adjusted in volume resistivity to $1\times10^{14}$ Ωcm was used for the partition layer, the resistance value of the 10 μm-thick parting layer was $6\times10^9\Omega$. The separation-offset level was the level "Fair".

Further, in Embodiment 1, as described also with reference to Tables 1 and 2, there is no problem with respect to the tailing level and the separation-offset level. From this experiment, it is understood that separation offset is worsened when the resistance value of the parting layer is excessively high and that tailing is worsened when the resistance value of the parting layer is excessively low.

It is understood that the resistance value of the parting layer suitable for not causing these image defects is about $6\times10^9\Omega$ or less.

Therefore, it is possible to constitute a fixing device that does not cause tailing and separation offset when the range of the resistance value of the base layer is $4\times10^6\Omega$ or less, the range of the resistance value of the adhesive layer is $3\times10^8\Omega$ or more, and the range of the resistance value of the parting layer is about $6\times10^9\Omega$ or less, and also when the electric resistance of the adhesive layer is larger than that of the parting layer and the electric resistance of the parting layer is larger than that of the base layer.

As described above, of the base layer, the adhesive layer and the parting layer, the voltage can be applied by lowering the resistance of the base layer to the smallest value. Further, the resistances of the remaining adhesive layer and parting layer are set at higher values than that of the base layer. The resistance of the adhesive layer is set at the highest value in order to improve the degree of tailing and the resistance of the parting layer is lowered to the degree that the separation offset can be prevented. That is, a relationship among the electric-resistance values with respect to the thickness direction of the respective layers is such that the resistance of the adhesive layer is larger than that of the parting layer and the resistance of the parting layer is larger than that of the base layer.

By this constitution, it is possible to strengthen the electric field for constraining the toner to the recording material without increasing the resistance of the parting layer, which is the outermost layer of the sleeve, to the extent that the separation offset occurs.

Further, by lowering the resistance of the base layer, the negative voltage can be applied to the base layer. As a result, it becomes possible to form the electric field for constraining the toner to the recording material by the voltage applied to the two layers consisting of the adhesive layer and the parting layer. The intensity of this electric field is determined by the sum total of the resistances of the two layers consisting of the adhesive layer and the parting layer. For this reason, even when the resistance of the parting layer, which is the outermost layer, is set at a low level in order to prevent separation offset, by increasing the resistance of the adhesive layer, the electric field intensity can be kept at a high level.

Therefore, the separation charging of the sleeve can be suppressed while sufficiently maintaining the constraint force of the toner onto the recording material, so that it is possible to prevent the occurrence of the image defects such as tailing and separation offset, and thus high-quality image formation can be effected.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 075768/2010 filed Mar. 29, 2010 and 061599/2011 filed Mar. 18, 2011, which are hereby incorporated by reference.

What is claimed is:

1. A fixing device for fixing on a recording material a toner image formed on the recording material, said fixing device comprising:

a flexible sleeve including a resinous base layer, a parting layer and an adhesive layer bonding the base layer and the parting layer;

a heater contacting an inner surface of said sleeve;

a pressing member configured to form a nip, in which the recording material on which the toner image has been formed is nipped and conveyed, between itself and said sleeve which said heater contacts;

a voltage applying member configured to apply a voltage, of a polarity identical to a polarity of toner; and a grounding member, contactable to the recording material in a nipped state in the nip, configured to ground the recording material, wherein in the base layer, an electroconductive filler is dispersed, wherein in a thickness direction of the layers, the electric resistance of the adhesive layer is larger than that of the parting layer and the electric resistance of the parting layer is larger than that of the base layer, and wherein said voltage applying member applies the voltage to said sleeve in contact with the base layer.

2. The fixing device according to claim 1, wherein the base layer is formed of polyimide.

3. The fixing device according to claim 1, wherein the electric resistance of said base layer is not more than $4\times10^6\Omega$.

4. The fixing device according to claim 1, wherein the electroconductive filler is a whisker-like filler.

5. The fixing device according to claim 4, wherein the whisker-like filler includes a carbon nanofiber or a carbon nanotube.

6. A flexible sleeve for use a fixing device for fixing on a recording material a toner image formed on the recording material, said flexible sleeve comprising:

a resinous base layer;

a parting layer; and an adhesive layer bonding said base layer and said parting layer, wherein in the base layer, an electroconductive filler is dispersed, wherein in a thickness direction of the layers, the electric resistance of said adhesive layer is larger than that of said parting layer and the electric resistance of said parting layer is larger than that of said base layer.

7. The flexible sleeve according to claim 6, wherein said base layer is formed of polyimide.

8. The flexible sleeve according to claim 6, wherein the electric resistance of said base layer is not more than $4\times10^6\Omega$.

9. The flexible sleeve according to claim 6, wherein the electro conductive filler is a whisker-like filler.

10. The flexible sleeve according to claim 9, wherein the whisker-like filler includes a carbon nanofiber or a carbon nanotube.

* * * * *